United States Patent [19]

Durant

[11] 4,025,225

[45] May 24, 1977

[54] DISC PUMP OR TURBINE

[75] Inventor: Donald S. Durant, Warren, Mich.

[73] Assignee: Robert R. Reed, Warren, Mich. ; a part interest

[22] Filed: Aug. 4, 1975

[21] Appl. No.: 601,465

[52] U.S. Cl. ..... 415/90; 416/228; 415/199.1

[51] Int. Cl.[2] ..... F03B 5/00

[58] Field of Search ..... 415/90, 60, 66, 194; 416/228

[56] References Cited

UNITED STATES PATENTS

| | | | |
|---|---|---|---|
| 2,087,834 | 7/1937 | Brown et al. | 415/90 |
| 2,997,847 | 8/1961 | Hollingsworth | 415/90 |
| 3,260,039 | 7/1966 | Brown et al. | 415/90 |
| 3,487,784 | 1/1970 | Rafferty et al. | 415/90 |
| 3,644,051 | 2/1972 | Shapiro | 416/228 |
| 3,746,467 | 7/1973 | Buse | 416/228 |

FOREIGN PATENTS OR APPLICATIONS

| | | | |
|---|---|---|---|
| 866,706 | 4/1941 | France | 415/90 |
| 179,043 | 5/1922 | United Kingdom | 415/90 |

*Primary Examiner*—Henry F. Raduazo
*Attorney, Agent, or Firm*—Gifford, Chandler, Sheridan & Sprinkle

[57] ABSTRACT

A pump or compressor includes a center inlet for directing a fluid into the open centers of a plurality of axially spaced rotatable discs or blades by which the fluid is directed radially outwardly to an outlet which is connected by a passage means to a center inlet of a second stage pumping unit. The spacing between the discs is decreased as the fluid is compressed or pressurized and means are provided on the tips of the discs to enhance the pumping action. The device, of course, can be used in reverse as a turbine.

1 Claim, 8 Drawing Figures

DISC PUMP OR TURBINE

BACKGROUND OF THE INVENTION

1. Field of the Invention

The present invention is directed to energy translation devices and more particularly to a pump or turbine of the centrifugal type and constructed of a plurality of spaced discs.

2. Prior Art

Pumps or turbines utilizing a plurality of rotatable, spaced discs are not new. Such devices have heretofore, however, had the disadvantage of being very inefficient. Such pumps have heretofore always included a plurality of spaced discs mounted at their centers to a shaft. The inlets have generally been disposed at the periphery of the discs 180° from the outlet. In those constructions where an inlet has attempted to be provided near the center of the discs the method of attaching the discs to the shaft has created obstructions which severely diminish the efficiency of the device.

Further, such pumps or turbines have generally been limited to a single stage and have utilized uniformly spaced blades or discs.

Also, when the device is used as a pump no means have been heretofore provided at the tips of the discs to enhance the pumping action.

SUMMARY OF THE PRESENT INVENTION

The present invention is directed to a pump or turbine in which the discs have an open center and are mounted to a circular member which is in turn mounted to the shaft. In this way the inlet (if the device is to be utilized as a compressor or pump) can be disposed at the center of the discs and the outlet can be disposed at the periphery. The unobstructed path between the inlet and the center of the blades has been found to greatly increase the efficiency of the device and convert what has been substantially an impractical apparatus to one which is highly practical.

Further the present invention is directed to a pump or turbine which utilizes a plurality of stages. The stages are constructed as modular units so that the number of such stages used in any pump or turbine can be varied to produce the desired result.

When the invention is used as a pump, each stage includes the unobstructed center inlet opening axially to the center of a plurality of spaced blades. Rotation of the discs then forces the fluid radially outwardly to compress it, if the fluid is air, or to increase its pressure if it is a liquid. The fluid is collected at the tips of the discs and is conducted radially inwardly to the center inlet of the next stage.

It has been found that reducing the spacing between the discs from one stage to the next greatly increases the efficiency of the pump especially if the device is being used to pump a compressible fluid. Also it has been found that the spacing between the discs is very important and must be varied in accordance with the viscosity of the fluid being pumped. If air is being pumped the blades or discs will be very closely spaced but if heavy oil is being pumped the blades will be spaced farther apart.

Also providing means on the edges of the discs to "sling" the fluid outwardly tends to produce a situation in which the fluid is directed outwardly from the discs at a speed which more closely approximates the tip speed of the discs than has been heretofore possible.

This same increase in efficiency is achieved when the device is used as a turbine. When it is used as a turbine the above indicated operation is, of course, reversed.

DESCRIPTION OF THE DRAWINGS

A better understanding of the present invention will be achieved upon reference to the following description which refers to the accompanying drawings in which like reference characters refer to like parts throughout the several views and in which.

DESCRIPTION OF SEVERAL PREFERRED EMBODIMENTS

Figure 1:
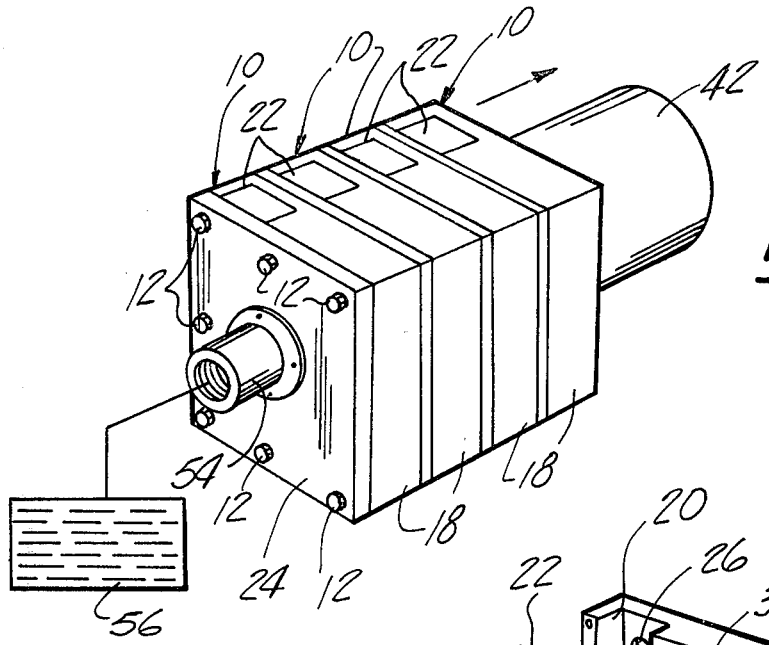
FIG. 1 is a perspective view of one preferred embodiment of the present invention.
Figure 2:
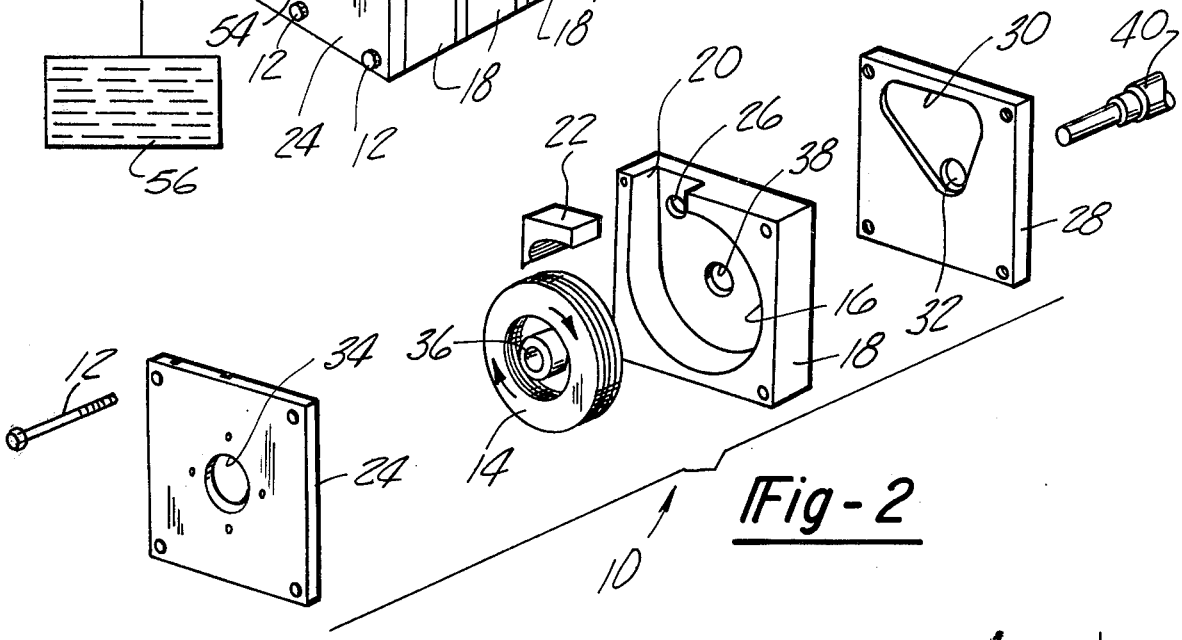
FIG. 2 is an exploded view of a portion of the structure shown in FIG. 1.
Figure 3:
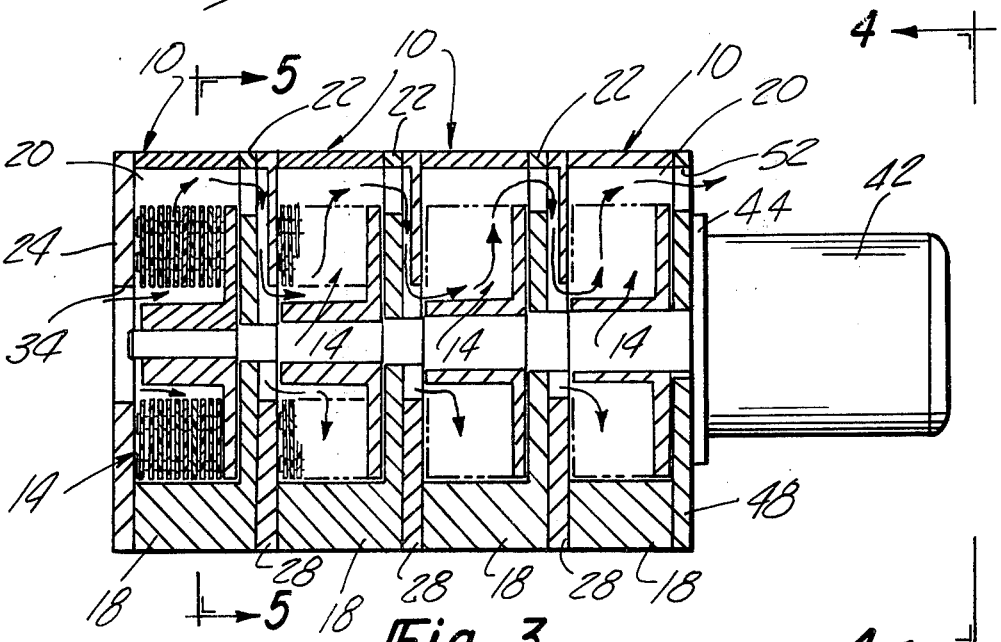
FIG. 3 is a cross sectional view of the device taken substantially along lines 3—3 of FIG. 5.
Figure 4:
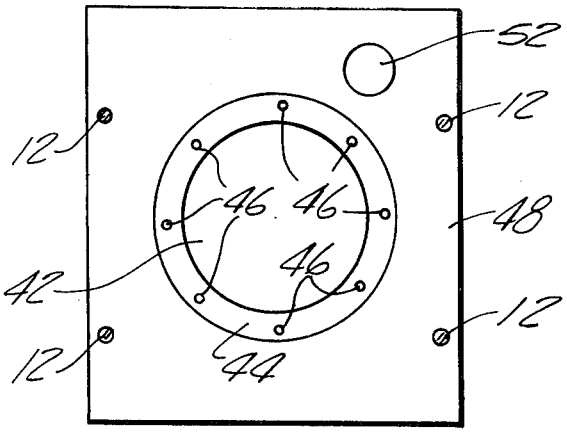
FIG. 4 is an end view as seen from line 4—4 of FIG. 3.

Now referring to the drawings for a more detailed description of the present invention, FIGS. 1–6 illustrate a first preferred embodiment as comprising a plurality of modular units 10 joined together by suitable fastening means 12 to provide a completed assembly. The particular assembly shown in FIGS. 1 and 3 is constructed by assembling four units 10 together although it will be apparent as the description proceeds that the assembly can consist of more or less of the units 10 as desired to suit the particular requirements of the use for which it is being designed.

Further, although the description of both preferred embodiments of the present invention are illustrated as compressors, it should be understood that this term is intended to encompass other fluid pumps as well and that by reversing the operation of the devices they become motors or turbines.

Referring now to FIG. 2 one of the units 10 is disclosed in exploded view. The unit 10 preferably comprises a fan 14 rotatably mounted in a substantially cylindrical chamber 16 of an intermediate housing 18. The chamber 16 opens to one face of the housing as shown and includes an outlet portion 20 extending from the upper periphery thereof. A deflector 22 is mounted in the outlet portion 20 by suitable fastening means (not shown).

A face plate 24, which is not a part of the unit 10 but is a part of the completed assembly, closes the chamber 16 and thereby encloses the fan 14.

An outlet opening 26 is formed through the intermediate housing 16 in registry with the outlet portion 20 of the chamber 16.

Still referring to FIG. 2 a manifold housing 28 is provided with a chamber 30 formed in one face thereof and registering near one edge with the outlet opening 26 and near another edge with a central opening 32. The face plate 24, the fan 14 and the intermediate housing 16 are provided with central openings 34, 36 and 38 respectively which when the unit is assembled are in axial alignment. These openings provide the means for receiving a stepped shaft 40 of a motor 42.

The motor 42 is provided with a peripheral flange 44 (FIG. 4) and fasteners 46 mount the flange 44 to a back plate 48 of the assembly. As can best be seen in FIGS. 3 and 4 the back plate 48 is also provided with a central opening 50 for receiving the shaft 40 of the motor 42 and is provided with an outlet opening 52 in the upper corner thereof.

As can best be seen in FIG. 3 each unit 10 comprises a fan 14, an intermediate housing 18 and a manifold housing 28. Any number of units 10 are mounted together between a single face plate 24 and a single back plate 48 to form a completed unit.

As the invention has thus far been described operation of the motor 42 produces rotation of the shaft 40 and thereby rotation of the fans 14. Air is drawn into the central opening 34 and is moved radially outwardly by the fan 14 in the first unit 10. An inlet fitting 59 can be mounted to the face plate 24, if desired as shown in FIG. 1, to facilitate connection of the inlet 34 to a source of fluid 56, other than air. The inlet 34 could, of course, be just open to the atmosphere. The deflector 22 directs the fluid to the outlet opening 26. The fluid flows then through the chamber 30 of the manifold housing 28 to the opening 32 which is the inlet for the next unit 10 of the assembly. Each unit 10 increases the compression of pressure of the fluid and it is finally discharged through the outlet opening 52 in the back plate 48.

This path of movement is shown by the arrows in FIG. 3.

Figure 5:
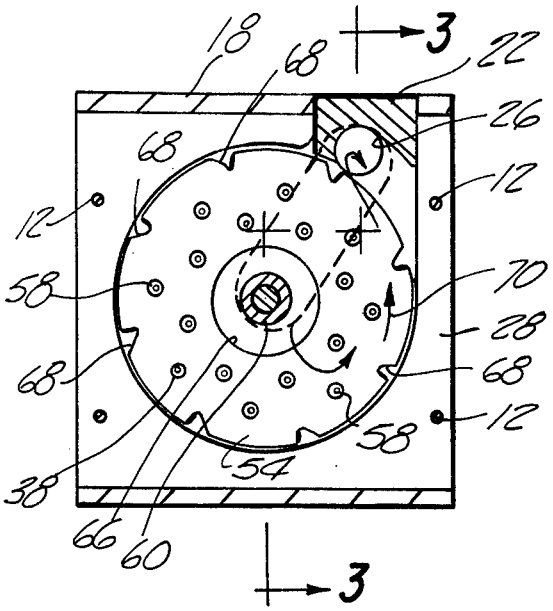
FIG. 5 is a cross sectional view as seen from line 5—5 of FIG. 3.
Figure 6:
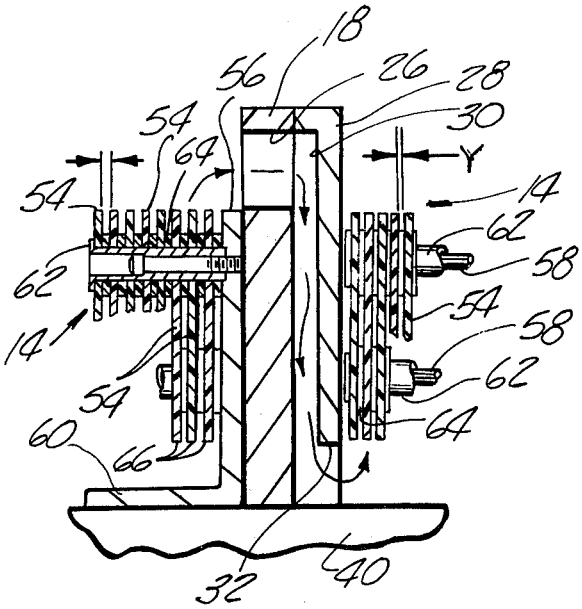
FIG. 6 is an enlarged, fragmentary view in section of a portion of the structure shown in FIG. 3.

The fans 14 are more clearly shown in FIGS. 5 and 6. Each of the fans 14 comprises a plurality of flat and substantially circular discs 54 mounted to a circular member 56 by fasteners 58.

The circular member 56 has an axially extending hub portion 60 which is fixed to the shaft 40 so that rotation of the shaft 40 rotates the circular member 56 and thus the discs 54.

The discs 54 are each provided with a central opening 66 substantially larger than the outer diameter of the hub portion 60 to provide unobstructed axial flow between the hub portion 60 and the inner diameter of the discs 54.

As can best be seen in FIG. 5 a number of the fasteners 58 are provided and they are located at different radial points.

Referring again to FIG. 6 the fasteners 58 preferably fit within tubular members 62 and circular spacers 64 are held in place between the discs 54 by the fasteners 58 and the tubular members 62. The spacers 64 are dimensioned such that the space $x$ between the discs 54 on the inlet side of the compressor assembly is greater than the space $y$ between the discs 54 downstream from the inlet side. Thus the spacing between the discs 54 diminishes in the direction of flow through the apparatus.

Referring particularly to FIG. 5 substantially U-shaped notches or slots 68 are preferably provided at the periphery of discs 54 and have a leading edge inclined in the direction of rotation of the discs 54. The direction of rotation is indicated by the arrow 70.

It has been found that decreasing the space between the discs 54 in the direction of flow through the device substantially contributes to the increased efficiency of the device. Because the gas is compressible, each stage in the compressor should reflect the difference in area the gas will occupy at different stages of compression. For example, if at one stage a spacing of 0.093 inches between the discs produces 3 inches in hg. the discs in the second stage should be spaced approximately 0.063 inches apart to provide the compressed gas the same volume it occupied as it left the first stage. If a third stage is used then the discs should be space apart approximately 0.050 inches.

The slots 68 tend to add a final fling to the fluid as it comes off the tips of the discs 54. In this way the speed of the fluid more closely approximates the tip speed of the discs thereby tending to produce a greater head pressure for the next stage and a greater suction head to suck the fluid from the center of the discs.

The unobstructed flow through the axial inlet provided by the particular manner utilized to attach the discs 54 to the circular member 56 produces a unit which is substantially more efficient than previous devices having either a peripheral inlet or an axial inlet having obstructions formed by the means for attaching the discs to the shaft.

It should be obvious that the devices which has been described can also be used as a turbine. Steam or other powered fluid would be forced in at the periphery of the discs and exit at the center to produce rotation of the shaft 40.

Figure 7:
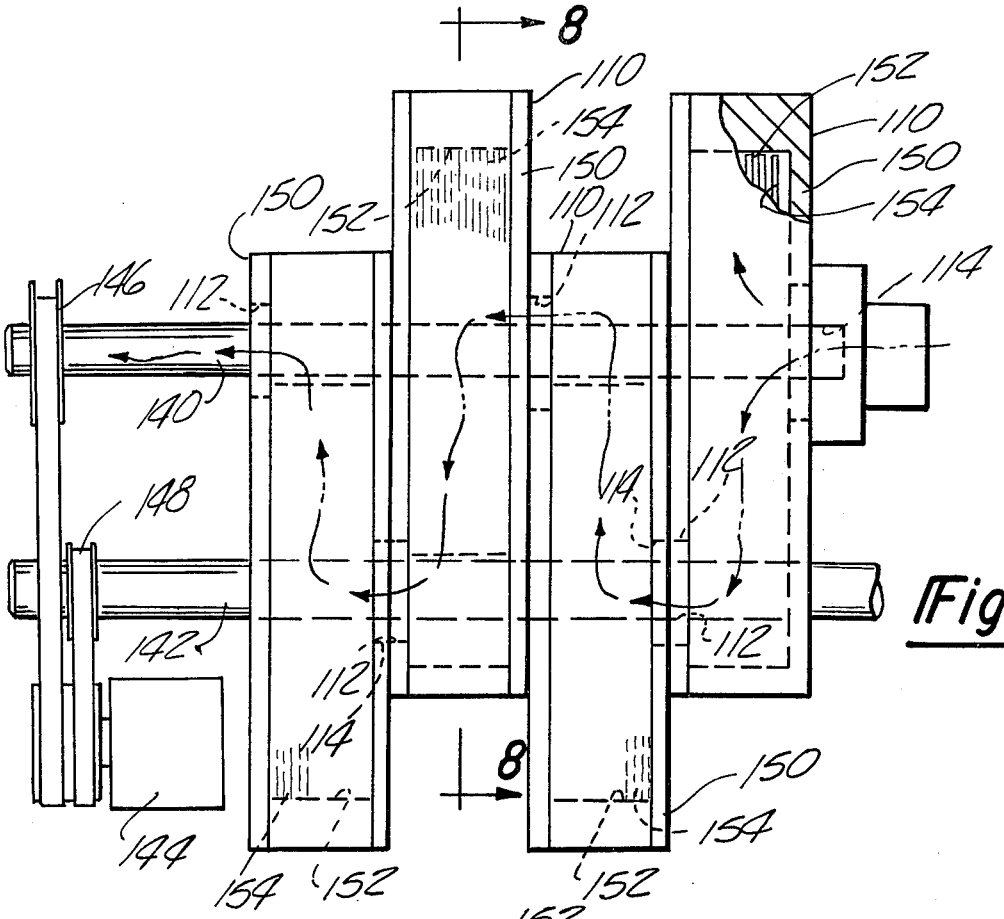
FIG. 7 is a side elevational view of another preferred embodiment of the present invention.
Figure 8:
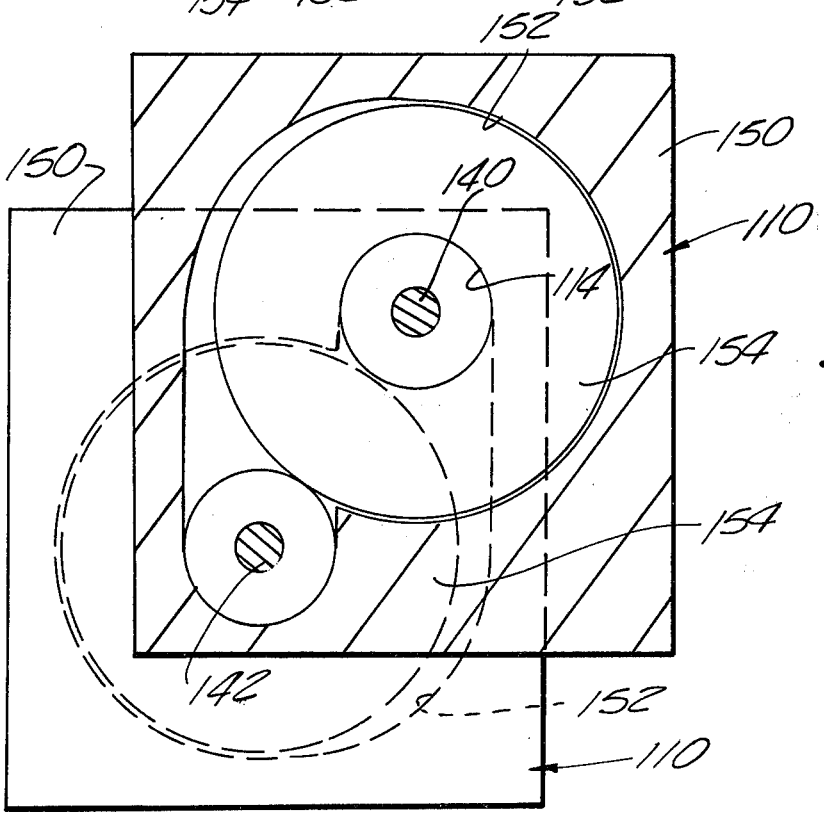
FIG. 8 is a cross sectional view taken substantially on line 7—7 of FIG. 8.

FIGS. 7 and 8 disclose another preferred embodiment of the present invention in which the units 110 which make up the stages of the apparatus are axially offset from each other so that the outlet 112 of one unit 110 is connected axially with the axial inlet 114 of the next unit 110.

A pair of shafts 140 and 142 extend through the aligned inlets 114 and outlets 112 are preferably driven by a single motor 144 by suitable pulleys 146 and a belt 148.

Each of the units 110 comprises a housing 150 having an interior chamber 152 open to the inlets 114 and the outlets 112. Fans 154, identical in construction to the fans 14 and with central, unobstructed inlets, are disposed within the housings 150 and are mounted to the shaft 140 or the shaft 142 in alternating fashion.

It should be apparent that the embodiment of FIGS. 7 and 8 has the advantage that a substantial portion of the structure required by the embodiment of FIGS. 1–6 is not necessary. Further, the direct connection between the outlet of one stage and the inlet of the next stage reduces pressure losses and thereby increases the efficiency of the apparatus.

It should also be apparent that although I have described several embodiments of my invention other changes and modifications can be made without departing from the spirit of the invention or the scope of the appended claims.

I claim:

1. An energy translating device comprising a housing means having an inlet means and an outlet means, said housing means comprising a plurality of housing units, each of said housing units having an inlet and an outlet with the outlet open to the inlet of the adjacent housing unit, and a deflector detachably connected to each of said housing units, said deflector having a concave axially extending wall portion for deflecting a peripheral fluid discharge axially into the inlet of the next adjacent housing unit, a shaft extending through and rotatably mounted with respect to each housing unit in said housing means, at least three discs mounted to said shaft within each of said housing units in said housing means, and means for axially spacing said discs from each other along said shaft, wherein said discs are substantially equidistantly axially spaced within each housing unit, wherein the axial spacing of the discs in each housing unit differs from its adjacent housing unit and wherein the axial spacing between the discs decreases from one end of the housing means to the other.

* * * * *